US009909286B2

(12) United States Patent
Meressa

(10) Patent No.: US 9,909,286 B2
(45) Date of Patent: Mar. 6, 2018

(54) PORTABLE HALF BATHROOM

(71) Applicant: Ybirhan Girmay Meressa, Portland, OR (US)

(72) Inventor: Ybirhan Girmay Meressa, Portland, OR (US)

( * ) Notice: Subject to any disclaimer, the term of this patent is extended or adjusted under 35 U.S.C. 154(b) by 1145 days.

(21) Appl. No.: 13/657,806

(22) Filed: Oct. 22, 2012

(65) Prior Publication Data

US 2014/0109310 A1 Apr. 24, 2014

(51) Int. Cl.

| | |
|---|---|
| ***E03C 1/01*** | (2006.01) |
| ***A47K 4/00*** | (2006.01) |
| ***A47B 85/00*** | (2006.01) |
| ***E03D 7/00*** | (2006.01) |
| ***E03D 11/12*** | (2006.01) |
| ***E04H 1/12*** | (2006.01) |

(52) U.S. Cl.

CPC ..... *E03C 1/01* (2013.01); *A47B 85/00* (2013.01); *A47K 4/00* (2013.01); *E03D 7/00* (2013.01); *E03D 11/12* (2013.01); *E04H 1/1266* (2013.01); *E03C 2201/90* (2013.01)

(58) Field of Classification Search

CPC ..... E04H 1/1216; A47K 4/00
USPC ..... 4/663–664, 476–477, 321, 449
See application file for complete search history.

(56) References Cited

U.S. PATENT DOCUMENTS

| | | | | |
|---|---|---|---|---|
| 200,480 | A * | 2/1878 | Rivera | 312/226 |
| 1,225,914 | A * | 5/1917 | Wood | 4/312 |
| 1,409,330 | A * | 3/1922 | Aper | 312/228 |
| 4,493,118 | A * | 1/1985 | Braxton | 4/460 |
| 5,379,466 | A * | 1/1995 | Davies | 4/449 |
| 2012/0144576 | A1* | 6/2012 | Taylor et al. | 4/476 |

* cited by examiner

*Primary Examiner* — Tuan N Nguyen
*Assistant Examiner* — William R Klotz
(74) *Attorney, Agent, or Firm* — Chen-Chi Lin

(57) ABSTRACT

A portable half bathroom is disclosed. The portable half bathroom may be in a compact condition or in an expanded condition. In the compact condition, the portable half bathroom looks like a regular cabinet. Collapsed and folded panels are attached to the cabinet. All side and back walls are racked on their relative sides of the cabinet when the portable half bathroom is not in use. In the expanded condition, the panels are unfolded and expanded to form an enclosure.

12 Claims, 4 Drawing Sheets

PORTABLE HALF BATHROOM

BACKGROUND OF THE INVENTION

This invention relates to restrooms or bathroom in general, and mobile or portable half bathroom in particular. Some outdoor activities and most unavoidable natural and manmade disasters increase the chance of defecation and urination in uncontrolled areas such as backyards, forests, water sources, (rivers, lakes, and the like) in a non hygienic manner; therefore enhances the risk of transmission of diseases such as cholera. The availability of portable bathrooms minimizes these risks.

Because they lack privacy, comfort, means of hygiene and convenience, prior arts in this field of invention have failed to provide the complete prevention to the health and environmental issues in relation to defecation and urination.

The portable half bath room of this invention looks a conventional cabinet on four wheels with breaks when not in use. Said portable half bathroom consists of a toilet that is deployable and retractable, foldable and stretchable covering means or walls for all sides, doors, flooring, roofing, wall mirror, sink, and faucet and water tank, that are deployable from the top surface of said cabinet.

The portable half bathroom of this invention can be one solution to the world's sanitation problems. It promotes the prevention of the spread of diseases such as cholera in disaster situations and evacuations such as during a major earthquake. In general, the portable half bathroom of this invention is used in places and occasions where and when conventional bathrooms are hard to reach for different reasons. It can be used for large or extended family houses or apartments that have shortage of bathrooms, in trailers and trailer parks, for RVs, on parking places, for construction sites, on barbecue areas, for camping, for road works, in medical facilities and the like.

Portability of a bathroom becomes important when space and mobility is considered. The current invention provides both mobility and resolves the issue of shortage in space through its portability.

DESCRIPTION OF PREFERRED EMBODIMENTS

Figure 1:
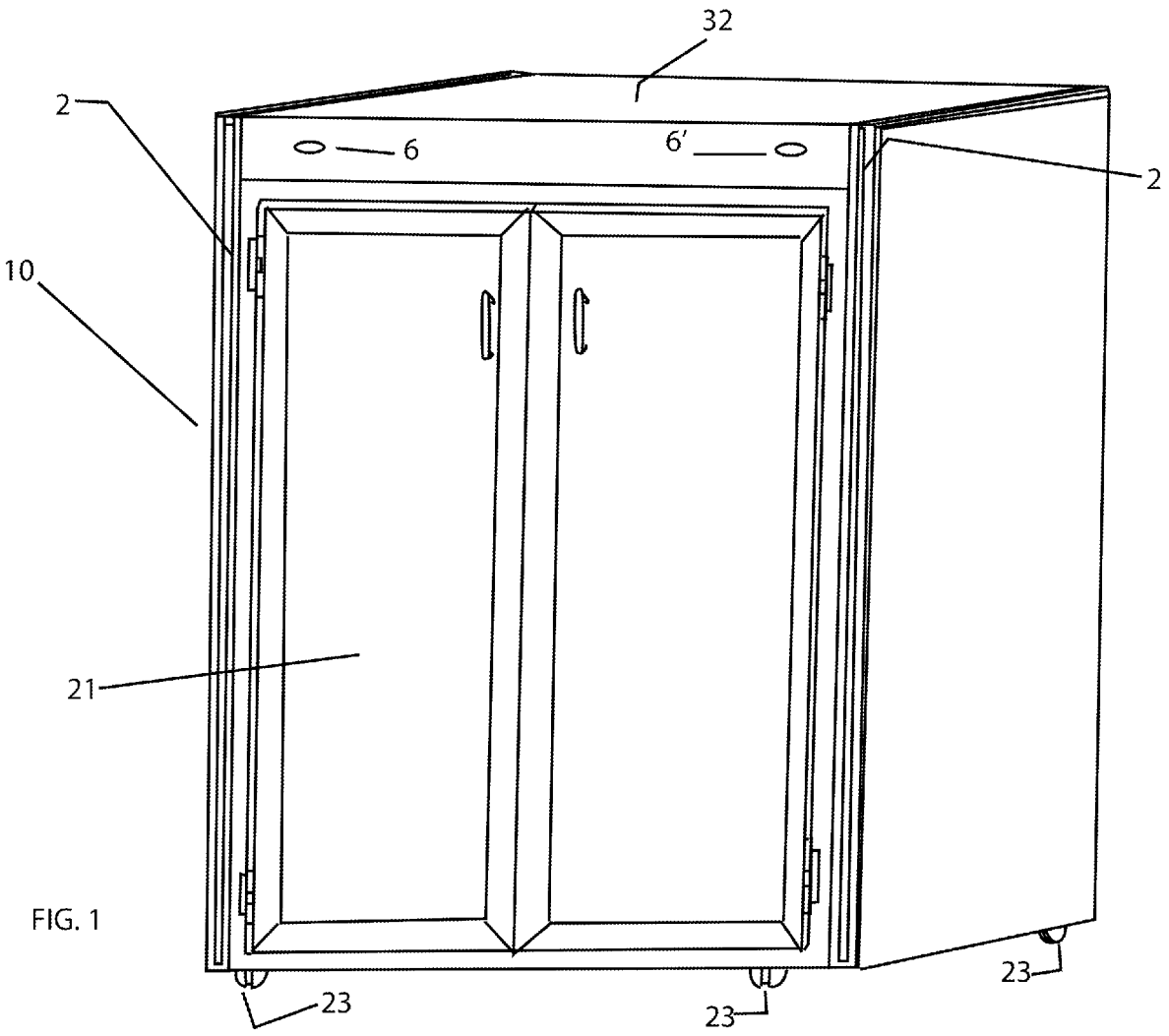
FIG. 1 represents a perspective view of the portable half bathroom when not in use.

The portable half bathroom of this invention is represented by the number 20. The portable half bathroom 20 looks like and is used as a conventional cabinet 10, until the need for half bathroom surfaces. FIG. 1 shows the portable half bathroom in a compact condition. FIG. 1 to FIG. 4 illustrate the cabinet 10 having a top surface 32, wall panels 2, doors 3, ceiling panels 5, release buttons 6 and 6', a four-leg toilet 7 having legs 18, a sink 9 having an opening 33, a faucet 11, containers 12, a tank 15, electrical plugs 16, wheels with brakes 23, a toilet paper holder 27, a back panel

30, handles 35, lighting systems 24 and 24', and everything that make the portable half bathroom 20 tact in place. Until it is needed to be used as a bathroom, the cabinet 10 is used as a regular cabinet and furniture of a house.

Figure 2:
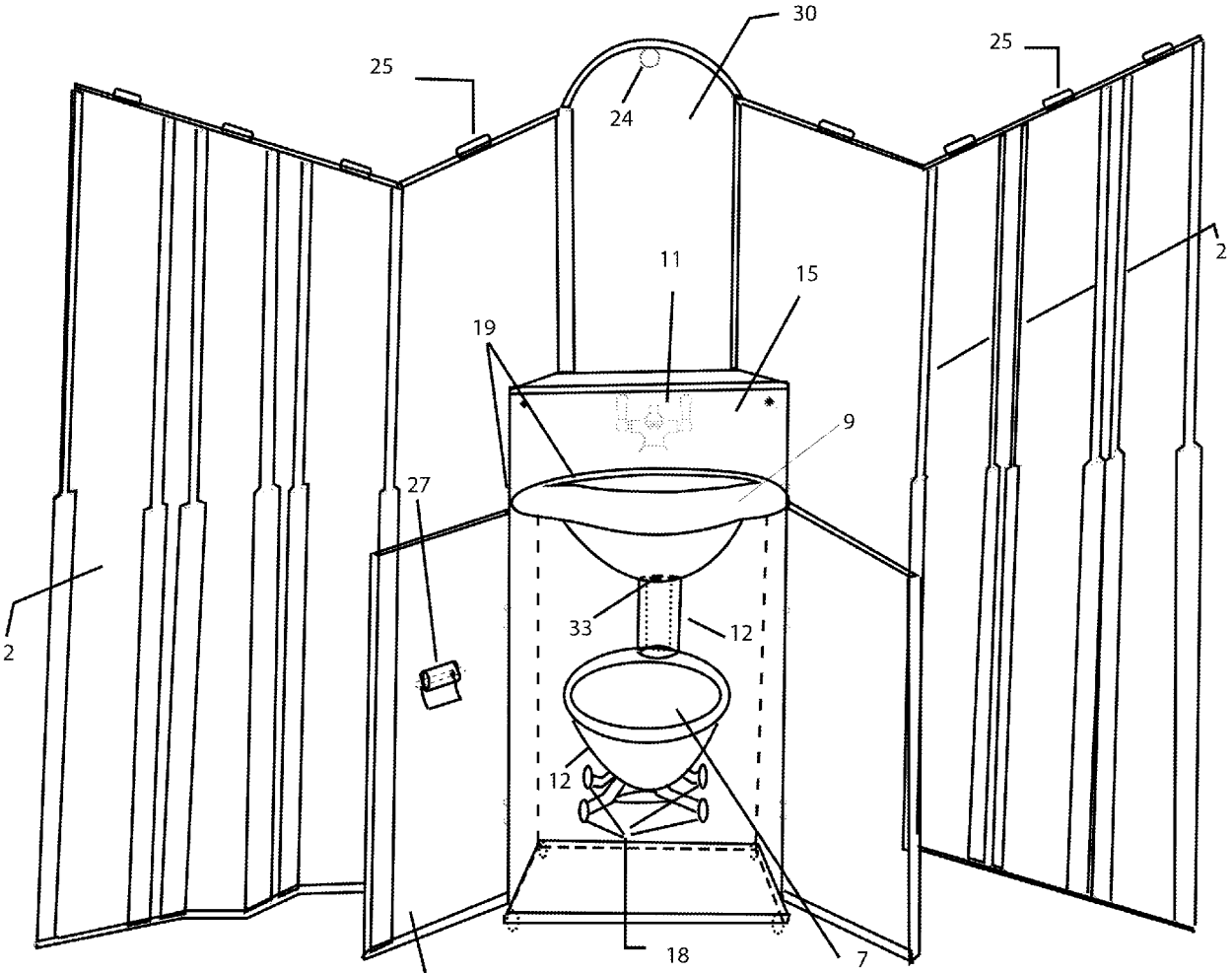
FIG. 2 shows an exploded front view of the cabinet and everything that makes it portable half bathroom being open.

When the need to use the portable half bathroom 20 surfaces, all the wall panels 2, and the doors 3, get pulled out via pulling-handles 25 or by pressing the release button 6, and unfold from the sides of the cabinet 10 to form a desired size room. The toilet 7, the tank 15, and the faucet 11, deploy for use then after. The toilet 7 comes out manually or automatically when cabinet doors 21 are opened. A collapsible venting system (In examples of the present disclosure, the venting system was known to a person of ordinary skill in the art on or before the filing date of the present application.) extends from the bottom of the toilet out up through the back wall of the portable half bathroom. The water tank 15 will be unfolded from a hinge 19 to a sitting position. The faucet 11 and the sink 9 will then be accessible for use. FIG. 2 shows that the wall panels 2 each have a first ply and a second ply. The second plies are pulled up along the vertical direction. In examples of the present disclosure, second plies are thinner than the first plies. The top ends of the second plies are higher than the top surface 32 of the cabinet 10 after the second plies are pulled up.

The disposable biodegradable waste container 12, which will be called bio-d-cont for short from here on, is hooked under a toilet seat 13 and the bottom of the sink 9. Bio-d-cont 12 is water resistant.

Figure 3:
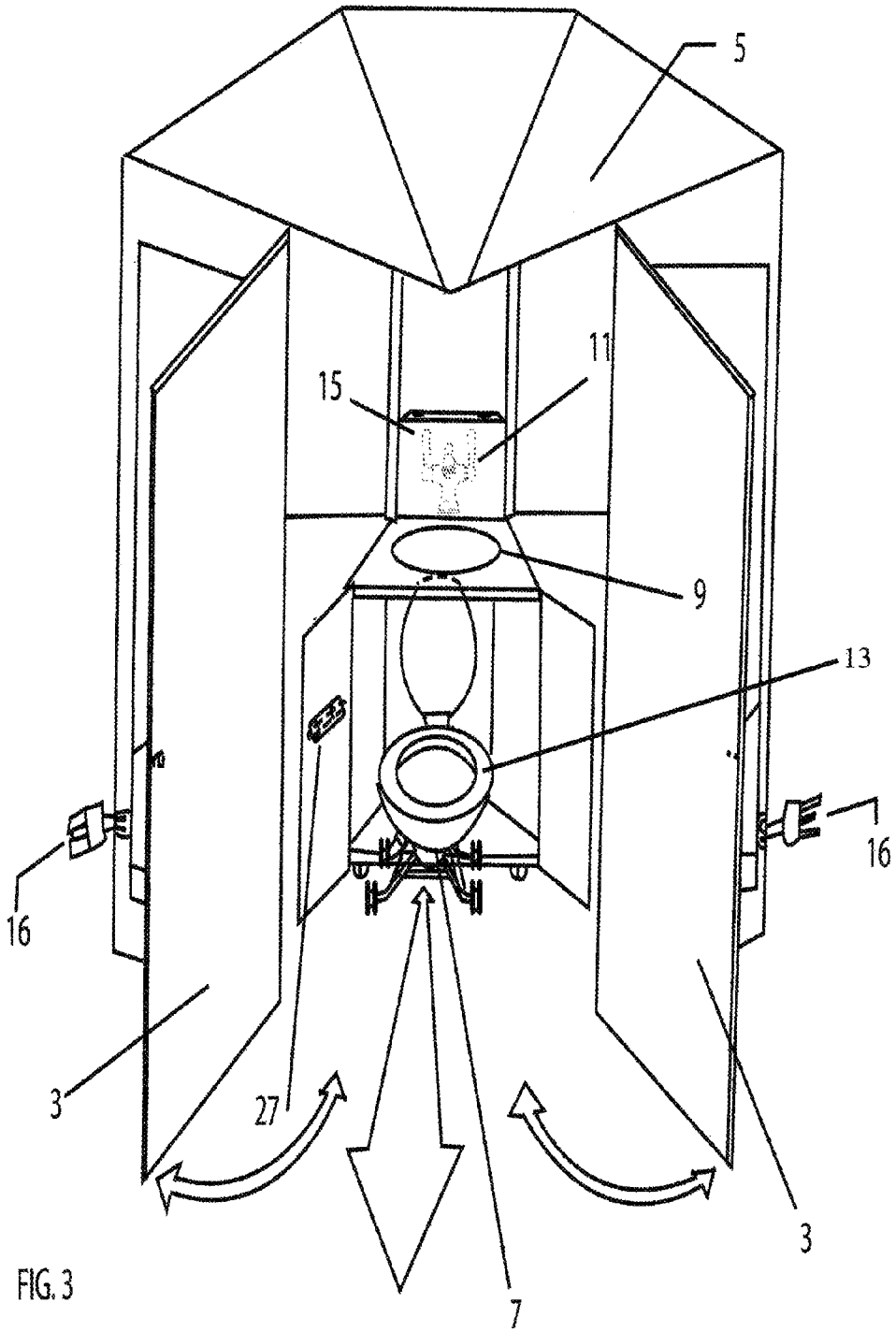
FIG. 3 indicates the portable half bathroom ready for service with all privacy installments pulled up, toilet, tank, faucet, and sink deployed, and doors opened.
Figure 4:
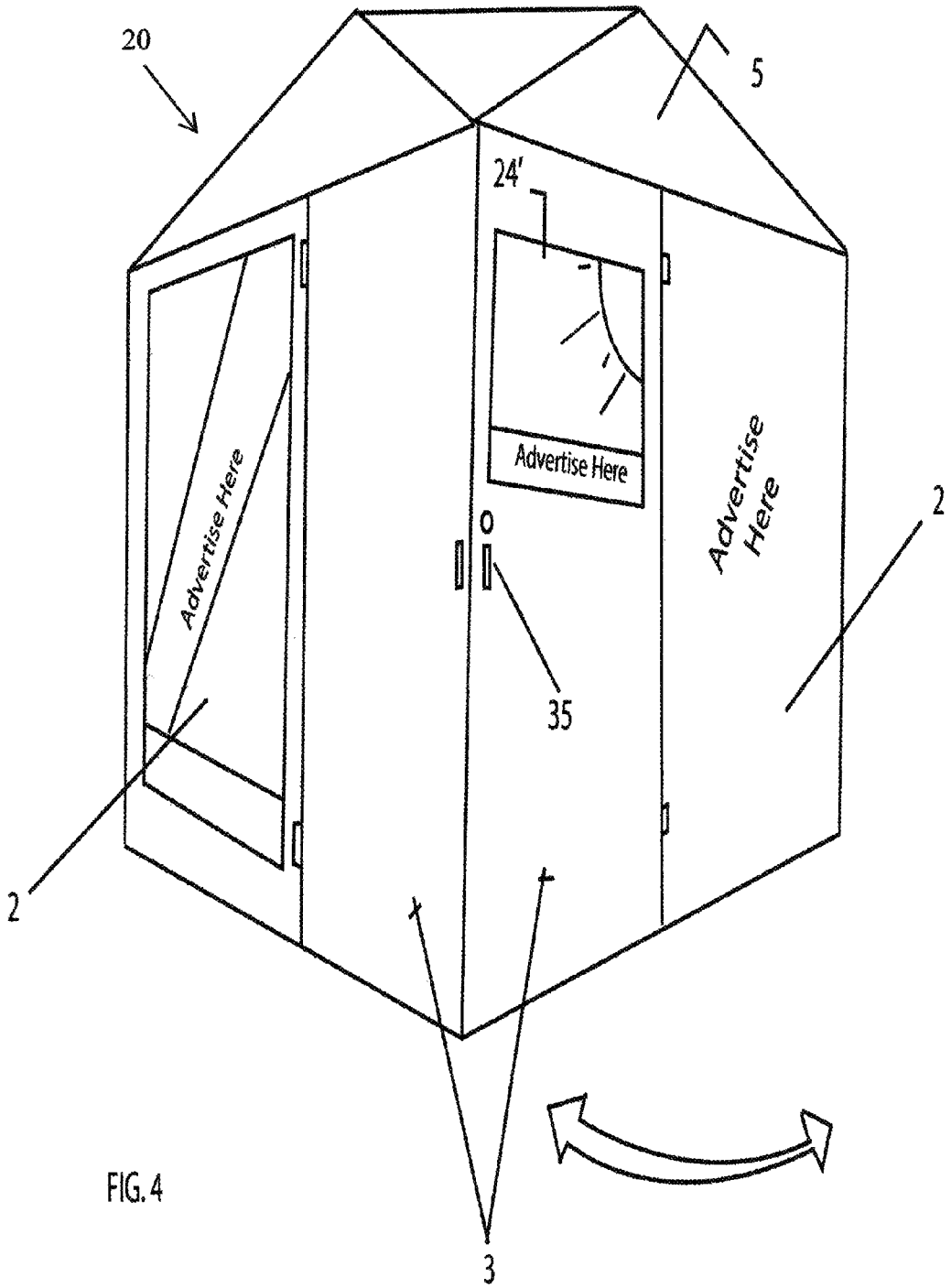
FIG. 4 indicates a perspective front view of the portable half bathroom in use forming certain size room; with privacy components in place.

As shown on FIG. 3, for outdoor use, the ceiling panels 5 will be deployed from the back of the cabinet 10 and unfold to cover. Also for outdoor use, a securing device (In examples of the present disclosure, the securing device was known to a person of ordinary skill in the art on or before the filing date of the present application.) secures the portable half bathroom 20 to the ground to prevent it from movement caused by wind, flood, and the like. FIG. 4 shows the portable half bathroom in an expanded condition. The wall panels 2 and ceiling panels 5 are unfolded and expanded.

The invention claimed is:

1. A portable half bathroom comprising:
- a cabinet comprising:
  - a cabinet door;
  - a cabinet back wall; and
  - a plurality of cabinet side walls including a first cabinet side wall and a second cabinet side wall;
- a plurality of collapsible and foldable bathroom panels comprising:
  - a first set of bathroom wall panels attached to the first cabinet side wall, wherein the first set of bathroom wall panels each have a first ply and a second ply;
  - a second set of bathroom wall panels attached to the second cabinet side wall, wherein the second set of bathroom wall panels each have a first ply and a second ply;
  - a bathroom door panel; and
  - a bathroom back panel attached to the cabinet back wall, wherein the bathroom back panel has a first ply and a second ply; and
  - a plurality of bathroom ceiling panels; and
- a movable toilet;
- a tank, a faucet, and a sink, wherein
- the portable half bathroom is characterized by:
  - a compact condition in which the plurality of bathroom panels are collapsed and folded; and
  - an expanded condition in which
    - the plurality of bathroom panels are unfolded and expanded;

the second plies of the first set of bathroom wall panels, the second plies of the second set of bathroom wall panels, and the second ply of the bathroom back panel are pulled up along a vertical direction; and the plurality of bathroom panels form an enclosure;

the cabinet further comprises a top layer and a bottom layer;

the tank and the faucet are attached to the top layer of the cabinet;

the sink is attached to the bottom layer of the cabinet; and the top layer of the cabinet is hingedly movable between a closed position in which the tank and the faucet are positioned in the sink; and an opened position in which the tank and the faucet are exposed.

2. The portable half bathroom of claim 1, wherein the plurality of bathroom panels are attachable and detachable.

3. The portable half bathroom of claim 1, wherein the size of the enclosure is adjustable by expanding different numbers of panels of the plurality of bathroom panels.

4. The portable half bathroom of claim 1, wherein the movable toilet comprises a plurality of foldable and stretchable legs.

5. The portable half bathroom of claim 1, further comprising a disposable waste container, wherein the disposable waste container is attached to the movable toilet.

6. The portable half bathroom of claim 1, wherein the cabinet further comprises wheels with breaks.

7. The portable half bathroom of claim 1, further comprising a water-proof, biodegradable waste container.

8. The portable half bathroom of claim 1, further comprising a lever movable between an activated position to hold the plurality of bathroom panels tightly; and a released position to release the plurality of bathroom panels.

9. The portable half bathroom of claim 1, wherein the enclosure is of a cubical shape, a cylindrical shape, a prism shape, or a pyramid shape.

10. The portable half bathroom of claim 1, wherein the cabinet and the plurality of bathroom panels are made of strong and light-weight materials.

11. The portable half bathroom of claim 1, further comprising a mirror, a toilet paper holder, a lighting assembly, and a floor.

12. A portable half bathroom comprising:

a cabinet comprising:

a cabinet door;

a cabinet back wall; and a plurality of cabinet side walls including a first cabinet side wall and a second cabinet side wall;

a plurality of collapsible and foldable bathroom panels comprising:

a first set of bathroom wall panels attached to the first cabinet side wall, wherein the first set of bathroom wall panels each have a first ply and a second ply;

a second set of bathroom wall panels attached to the second cabinet side wall, wherein the second set of bathroom wall panels each have a first ply and a second ply;

a bathroom door panel; and a bathroom back panel attached to the cabinet back wall, wherein the bathroom back panel has a first ply and a second ply; and a plurality of bathroom ceiling panels;

a movable toilet;

a tank, a faucet attached to the tank, and a sink, wherein the portable half bathroom is characterized by:

a compact condition in which the plurality of bathroom panels are collapsed and folded; and an expanded condition in which the plurality of bathroom panels are unfolded and expanded;

the second plies of the first set of bathroom wall panels, the second plies of the second set of bathroom wall panels, and the second ply of the bathroom back panel are pulled up along a vertical direction; and the plurality of bathroom panels form an enclosure;

the cabinet further comprises a top layer and a bottom layer;

the tank is attached to the top layer of the cabinet;

the sink is attached to the bottom layer of the cabinet; and the top layer of the cabinet is hingedly movable between a closed position in which the tank and the faucet are positioned in the sink; and an opened position in which the tank and the faucet are exposed.

* * * * *